US006334375B1

(12) United States Patent
Belcher

(10) Patent No.: US 6,334,375 B1
(45) Date of Patent: Jan. 1, 2002

(54) TOOL FOR ENGINE CRANK SHAFT

(76) Inventor: Horace Belcher, 225 Collier Rd., Clarksville, TN (US) 37042

( * ) Notice: Subject to any disclaimer, the term of this patent is extended or adjusted under 35 U.S.C. 154(b) by 0 days.

(21) Appl. No.: 09/759,488

(22) Filed: Jan. 16, 2001

(51) Int. Cl.[7] ..... B25B 13/48
(52) U.S. Cl. ..... 81/176.1; 81/13
(58) Field of Search ..... 81/13, 487, 176.1, 81/176.15, 176.2

(56) References Cited

U.S. PATENT DOCUMENTS 1,709,075 A * 4/1929 Howard ..... 81/176.1
2,394,808 A * 2/1946 Rohr ..... 81/176.1
2,468,983 A * 5/1949 Johnson ..... 81/13
3,768,345 A * 10/1973 Barnes ..... 81/176.15
4,580,446 A 4/1986 Ansteth
4,885,834 A * 12/1989 Beerman ..... 81/13
4,922,749 A 5/1990 Steffes et al.
4,934,037 A * 6/1990 Schuerg et al. ..... 81/488
5,018,410 A * 5/1991 Farnsworth ..... 81/13
5,188,008 A * 2/1993 States ..... 81/13
5,257,556 A 11/1993 Pineault .....

* cited by examiner

*Primary Examiner*—Eileen P. Morgan
*Assistant Examiner*—Toni B. Danganan
(74) *Attorney, Agent, or Firm*—Richard C. Litman

(57) ABSTRACT

A tool for holding the pulley of the engine crankshaft stationary while loosening or tightening the crankshaft sprocket bolt. In a first embodiment, the crankshaft pulley holding implement has two piece construction that employs a changeable baseplate for crankshaft pulleys of different sizes. In a second embodiment, the tool has a one piece construction that is less expensive to manufacture. In both embodiments, the tool has a square hole defined therein for receiving a square drive breaker bar and a concave inside edge having a plurality of symmetrically disposed recesses for engaging crankshaft pulley bolts, so that the tool may be placed about the crankshaft pulley bolts and held stationary with the breaker bar while tightening or loosening the crankshaft sprocket bolt.

14 Claims, 11 Drawing Sheets

TOOL FOR ENGINE CRANK SHAFT

BACKGROUND OF THE INVENTION

1. Field of the Invention

The present invention relates generally to crankshafts and more particularly, to a tool for an engine crankshaft pulley designed to hold the crankshaft pulley stationary while installing or removing the crankshaft sprocket bolt.

2. Description of the Related Art

A frequently encountered problem when attempting to remove or install the crankshaft sprocket bolt is that the crankshaft pulley rotates when a torque is applied to the crankshaft sprocket bolt making it difficult to either loosen or tighten the crankshaft sprocket bolt. For the crankshaft sprocket bolt to be readily loosened or tightened, it is required that the crankshaft pulley remain stationary as a torque is applied to the crankshaft sprocket bolt because the rotation of the crankshaft pulley prevents an adequate torque from being applied to the crankshaft sprocket bolt. However, the work space involved is very restricted, therefore, the auto mechanic has very little room in which to work, which severely limits the number of viable options available to the auto mechanic for holding the crankshaft pulley stationary.

The prior art describes a variety of implements used to facilitate the installation and removal of various automotive components. U.S. Pat. No. 4,580,446 issued on Apr. 8, 1986 to J. J. Ansteth describes a degree wheel and a method of using the degree wheel. The novel degree wheel is adjustably mounted to the crankshaft. The degree wheel is mounted to a bushing by a threaded nut that is loosened or tightened as desired. The wheel can be easily adjusted so that a zero degree reading corresponds to a top dead center of piston travel. The degree wheel includes counterclockwise 0 degree to 360 degree indicia for a direct and calculation-free determination of the duration of tappet lift.

An engine crankshaft indexing method and tool is described in U.S. Pat. No. 4,922,749 issued on May 8, 1990 to T. J. Steffes. The crankshaft rotation tool and method facilitates tests and the making of repair adjustments requiring precise indexing of the degrees of the crankshaft rotation. The tool engages and imparts rotation to existing bolts that mount an existing pulley to the crankshaft.

U.S. Pat. No. 5,257,556 issued on Nov. 2, 1993 to R. P. Pineault describes a torque technique and apparatus. The tool which produces a measured torque is coupled to a bolt head or nut located in a relatively inaccessible area by an apparatus which includes a wrench member affixed to an adaptor. The wrench member is sized and shaped to engage the fastener to be operated upon and the adaptor has a tubular construction with a tool engaging socket at one end. The adaptor is provided with an elongated slot which accommodates any wires which may pass through the fastener.

None of the above inventions and patents, taken either singularly or in combination, is seen to describe the instant invention as claimed. Thus a tool for preventing engine crank shaft rotation when installing or removing the crankshaft sprocket bolt, thus solving the aforementioned problems, is desired.

SUMMARY OF THE INVENTION

Accordingly, it is a principal object of the invention to provide a tool that facilitates the removal and installation of a crankshaft sprocket bolt.

It is another object of the invention to provide a tool that prevents crankshaft rotation when installing and removing a crankshaft sprocket bolt.

It is a further object of the invention to provide a tool that prevents crankshaft rotation when installing and removing a crankshaft sprocket bolt which may be used where working space is confined so that the crankshaft sprocket bolt may be removed while the engine is still in the engine compartment of the vehicle.

Still another object of the invention is to provide a tool for preventing rotation of the crankshaft during crankshaft sprocket bolt removal that is sturdy and durable.

It is an object of the invention to provide improved elements and arrangements thereof for the purposes described which is inexpensive, dependable and fully effective in accomplishing its intended purposes.

The foregoing objectives are achieved in accordance with the present invention by providing a tool that facilitates the removal and installation of the crankshaft sprocket bolt. The implement of the present invention is installed on the crankshaft pulley and holds the crankshaft pulley stationary as a torque is applied to the crankshaft sprocket bolt by a mechanic using a wrench. The operational end of a breaker bar is inserted into an appropriately configured opening in the tool to hold the tool and crankshaft pulley stationary as a wrench applies a torque to the crankshaft sprocket bolt to either loosen the sprocket bolt for removal or to tighten the sprocket bolt during installation of the sprocket bolt.

The tool of the present invention eliminates the possibility of accidentally damaging the fly wheel, pulleys, belts, and timing plate on the timing belt cover while removing or installing the crankshaft sprocket bolt. The solid construction of the tool of the present invention provides the mechanic with a sturdy and durable implement that can endure the rigors of frequent and repeated use. The innovative contour of the tool allows the implement to be quickly and easily installed and removed from the crankshaft pulley. The tool of the present invention eliminates the possibility of damage to the engine as a result of inadvertent rotation of the crankshaft while removing or installing the crankshaft sprocket bolt.

In a first embodiment, the tool has a two piece construction with a detachable upper portion and an exchangeable lower portion. The two piece construction allows a user to interchange the upper portion with lower portions of different configurations adapted to fit crankshaft pulleys of different sizes. In a second embodiment, the tool has a one piece construction that is less expensive to manufacture.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
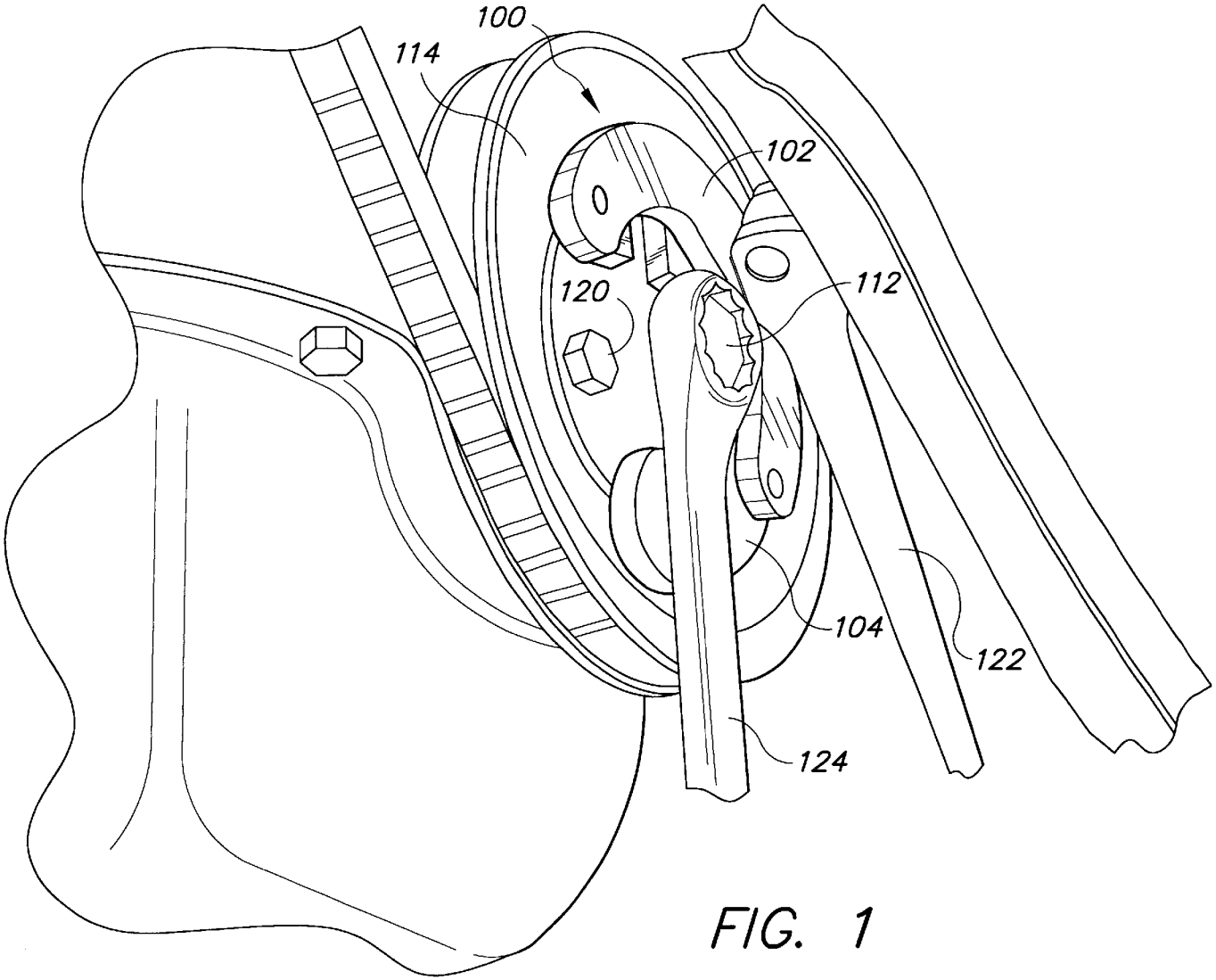
FIG. 1 is an environmental, perspective view of a first embodiment of the tool in use according to the present invention.

The present invention, as depicted in FIGS. 1–11, is a tool 100 that allows a mechanic to readily remove the crankshaft sprocket bolt 112. The implement 100 of the present invention prevents the crankshaft shaft pulley 114 from rotating as a torque is applied to the crankshaft sprocket bolt 112 as shown in FIG. 1. FIG. 1 is an environmental, perspective view of a first embodiment of the tool 100 in use. The tool 100 is mounted onto the crankshaft pulley 114 with three of the four crankshaft pulley bolts 120 disposed within the grooves or recesses 116 defined in the baseplate portion 104 of the tool 100. With a breaker bar 122 in one hand and a wrench 124 in the other hand, a mechanic using the wrench 124 applies a torque to the crankshaft sprocket bolt 112 while holding the tool 100 stationary using the breaker bar 122 as shown in FIG. 1. As a torque is applied to the crankshaft sprocket bolt 112 using a wrench 124, the crankshaft pulley 114 is prevented from rotating in the direction of the applied torque by the pulley bolts 120 engaging the baseplate portion 104 of the tool 100 which is held in place by the breaker bar 122.

Figure 2:
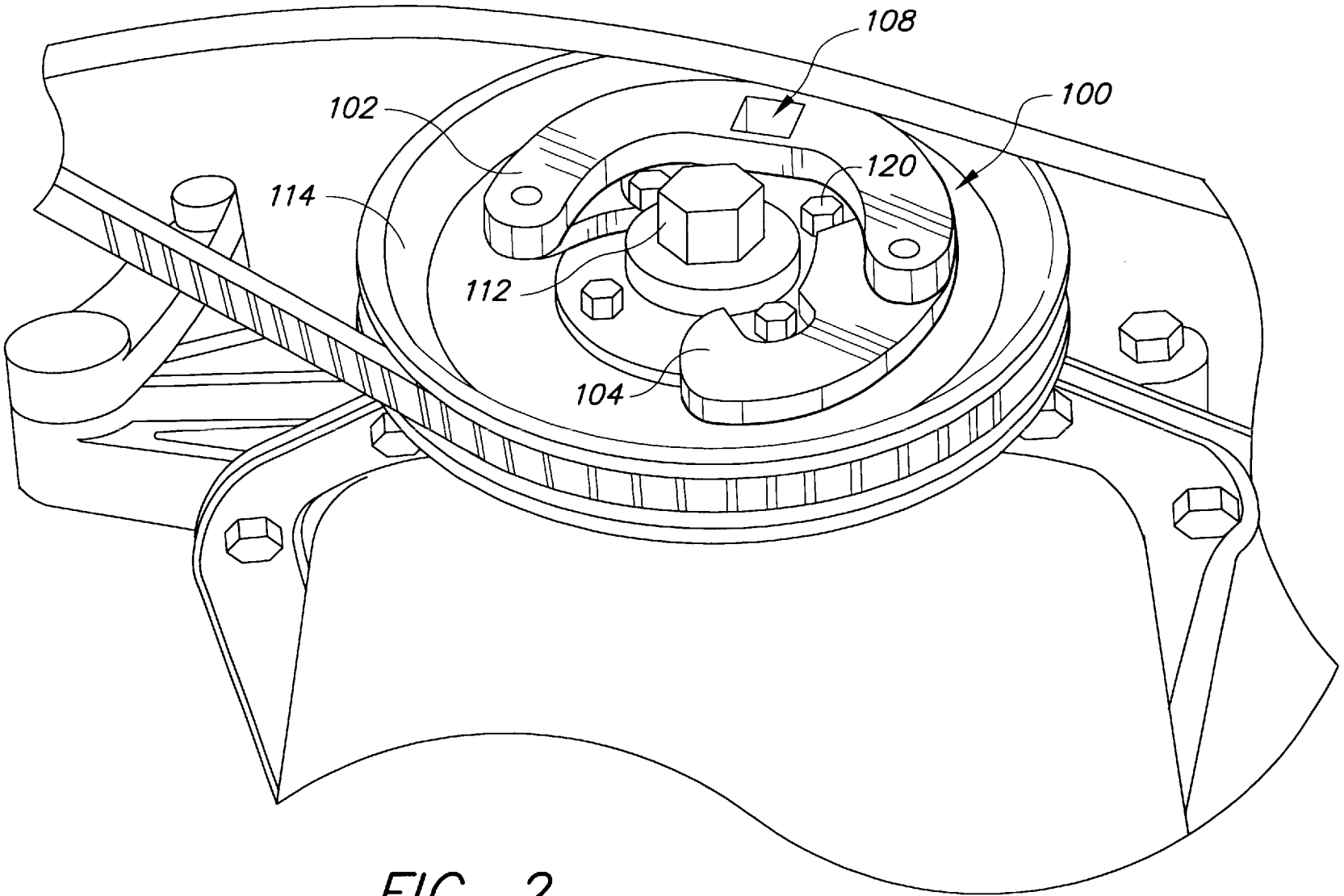
FIG. 2 is an environmental, perspective view of a crankshaft pulley with the assembled tool installed.
Figure 3:
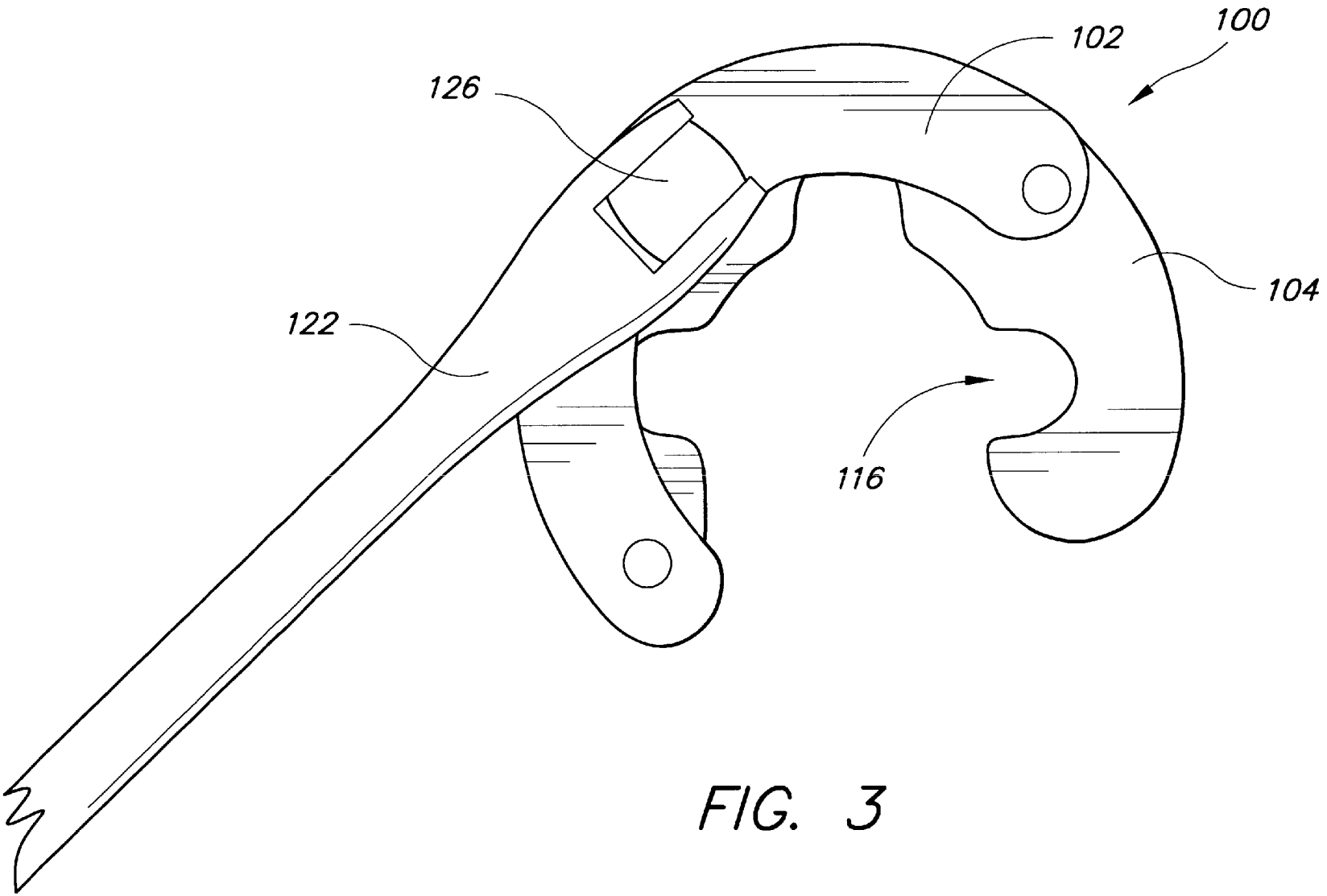
FIG. 3 is a perspective view of the assembled tool with the breaker bar installed.
Figure 4:
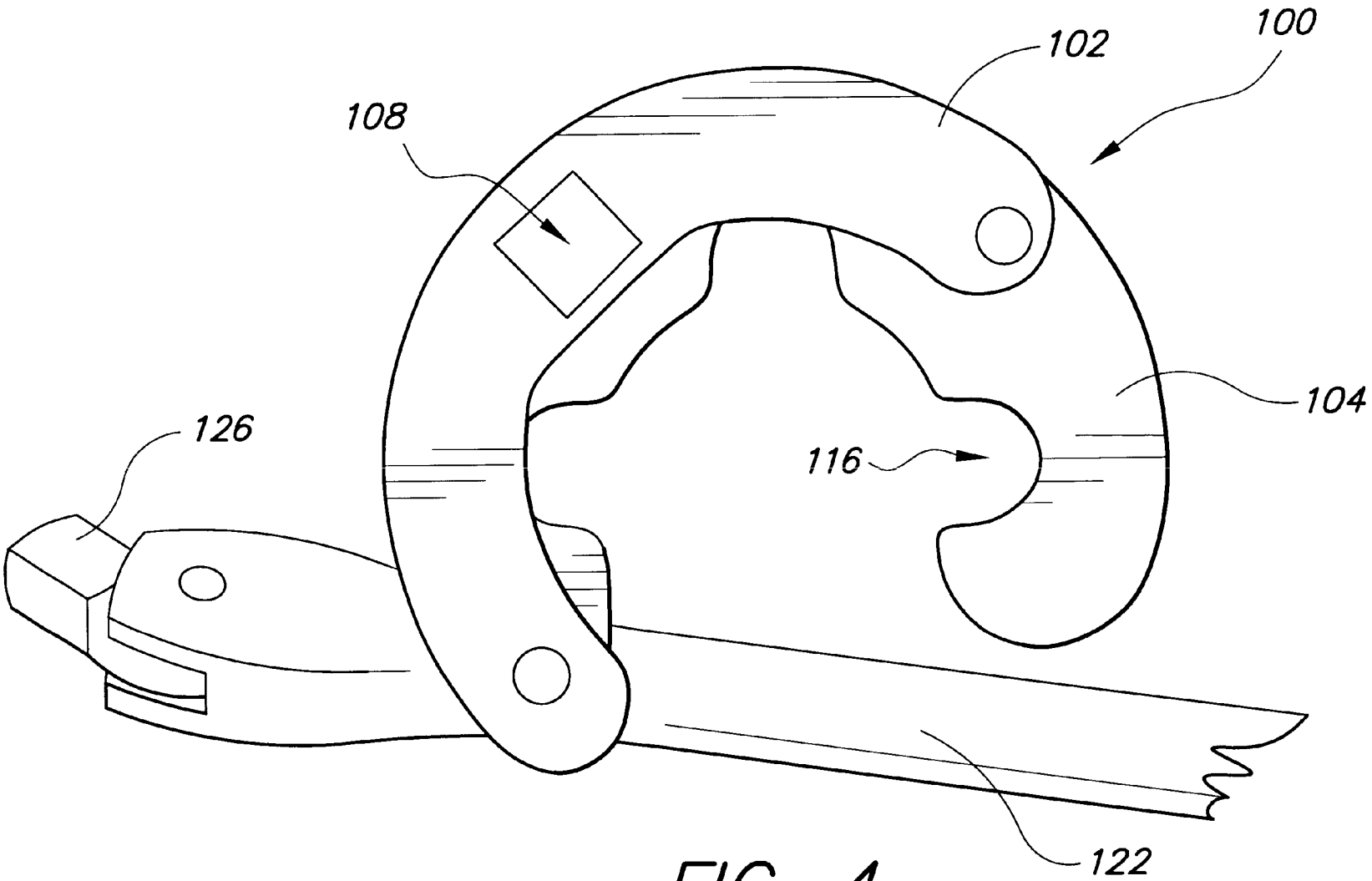
FIG. 4 is a perspective view of the assembled tool and a breaker bar.

FIG. 2 is an environmental, perspective view of a crankshaft pulley 114 with the assembled tool 100 installed showing how the tool 100 is sized to fit neatly over three of the crankshaft pulley bolts 120. The recesses 116 of the baseplate portion 104 of the tool 100 are sized to accommodate the heads of the crankshaft pulley bolts 120 employed. FIG. 3 is a perspective view of the assembled tool 100 with the breaker bar 122 installed showing how the drive 126 of the breaker bar 122 fits snugly and securely into the square drive hole 108. The shape of the drive opening 108 (see FIG. 2) can be changed to accommodate the needs of the user. FIG. 4 is a perspective view of the assembled tool 100 with a disengaged breaker bar 122.

Figure 5:
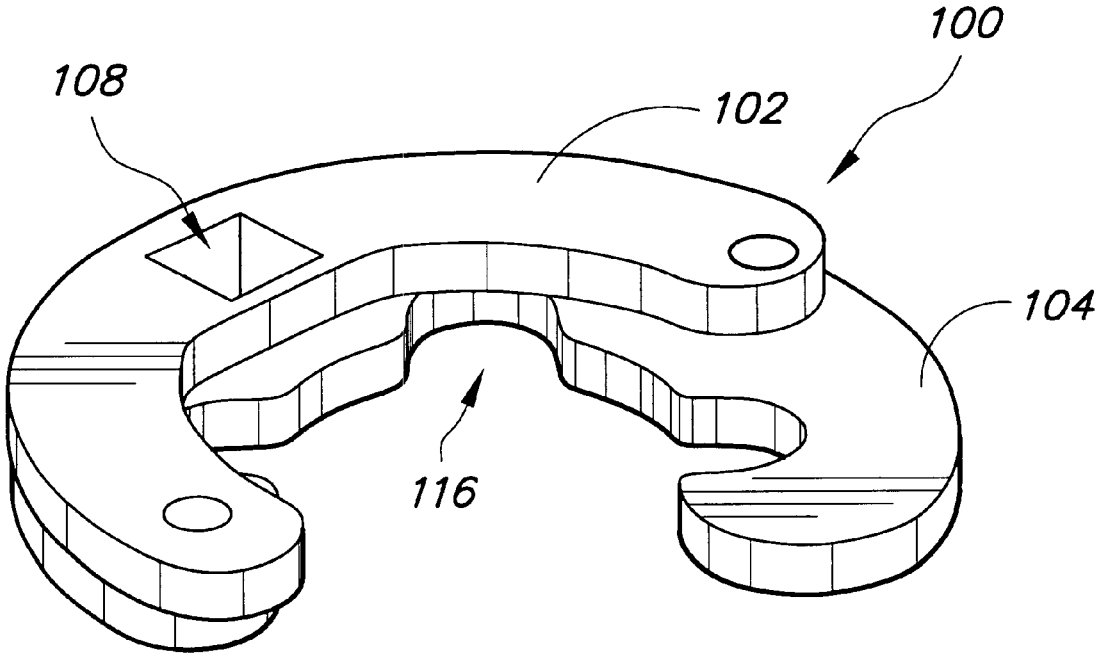
FIG. 5 is a perspective view of the assembled tool.
Figure 6:
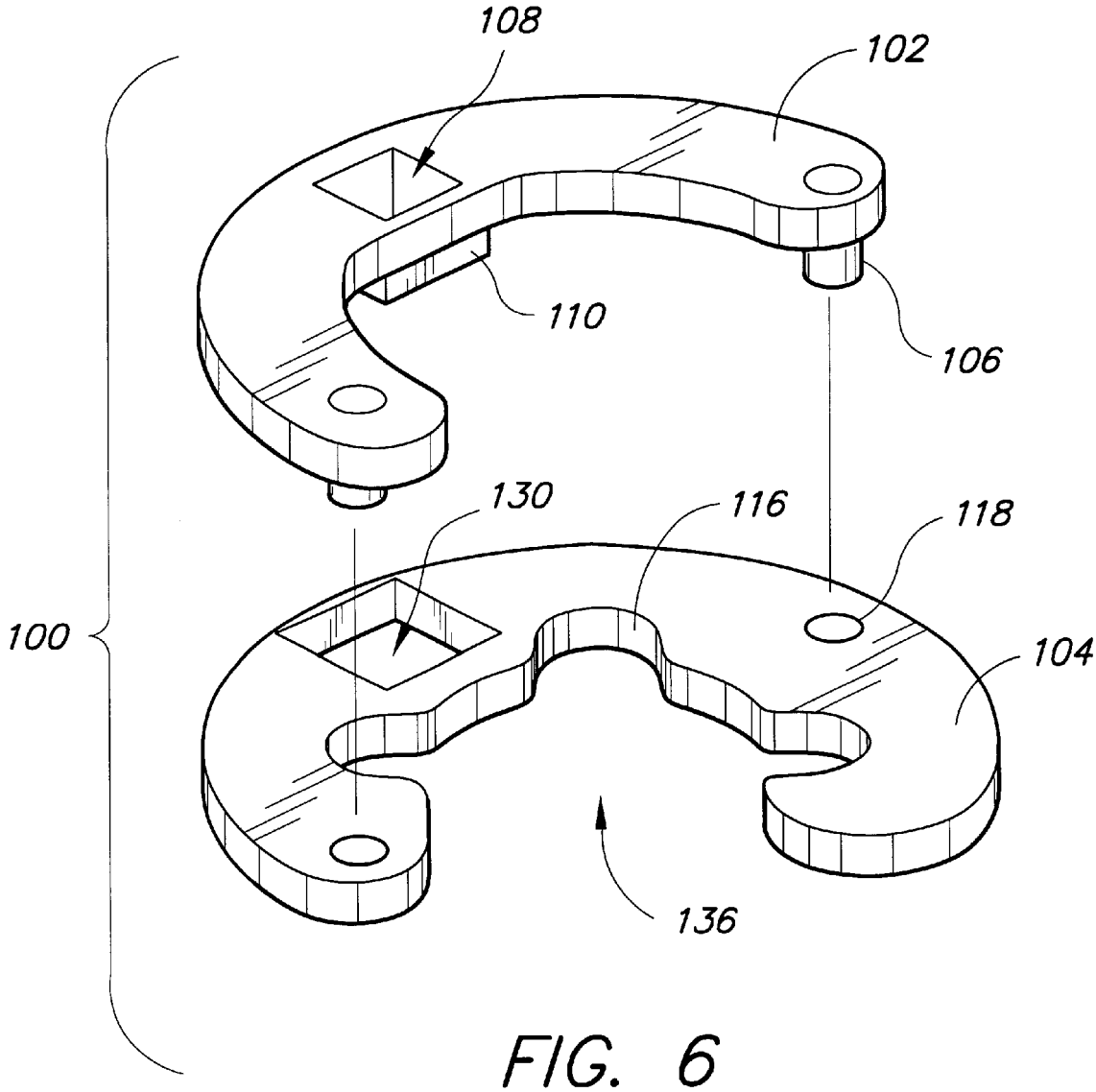
FIG. 6 is an exploded view of the tool showing the two piece construction of the tool.

FIG. 5 is a perspective view of the assembled tool 100 showing the distinctive contour of the tool 100. FIG. 6 is an exploded view of the tool 100 showing the two piece construction of the first embodiment of the tool 100. The two piece embodiment of the tool 100 consists of a flat, detachable, arcuate top plate 102 that has a medially disposed ½ inch square hole 108 defined in a boss 110 that protrudes downward when the top or upper plate 102 of the tool 100 is oriented as shown in FIG. 5 and a pair of laterally disposed dowel pins 106 that also extend downward as shown in FIG. 6. Although the hole 108 and boss 110 are preferably square to accept the more commonly used square drive breaker bars, it will be understood that the hole 108 may be hexagonal, octagonal, or other polygonal shape to accommodate the less commonly used hexagonal or octagonal drive tools.

The removable baseplate or bottom portion 104 of the tool 100 also has a flat, arcuate shape. The baseplate 104 of the tool 100 has a ¾ inch square opening 130 that is disposed slightly eccentrically as shown in FIG. 6. In addition, the baseplate 104 has a pair of openings or holes 118 to accommodate the dowel pins 106 of the upper portion 102 of the tool 100 and a set of three recesses 116 to accommodate the bolts 120 of the crankshaft pulley 114. The three recesses 116 can be configured to fit the contour or shape of the crankshaft pulley bolts 120. The primary purpose of the ¾ inch square aperture 130 and dowel pins holes 106 is to allow bottom plates 104 of different designs to be attached to the top portion 102. The bottom plate 104 depicted in the first embodiment of the tool 100 is for a crankshaft pulley 114 with four bolts 120. As shown in FIG. 6, each recess has opposing faces spaced apart a predetermined distance for engaging the opposing faces of a crankshaft pulley bolt 120 in order to prevent rotation of the bolt 120.

Figure 7:
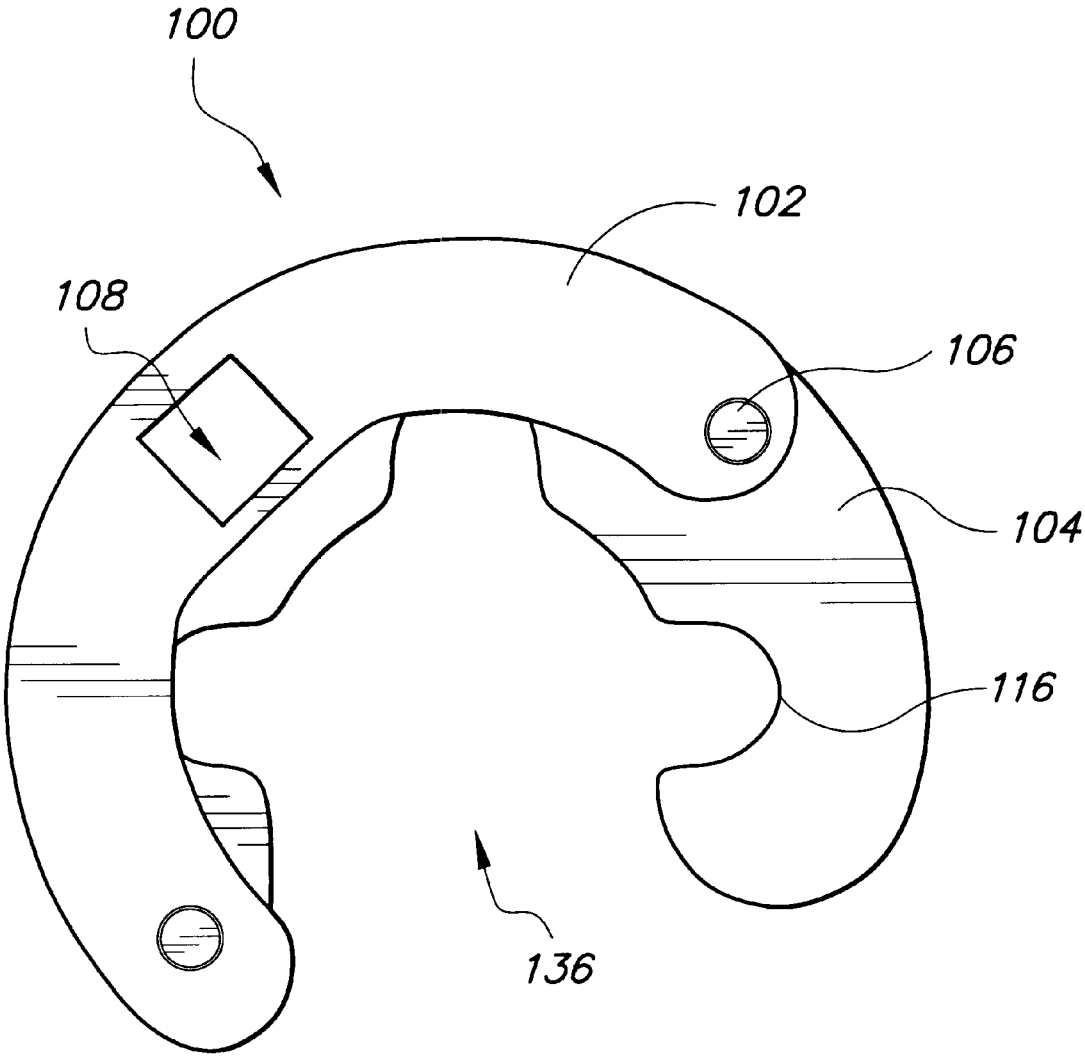
FIG. 7 is a top view of the assembled tool.
Figure 8:
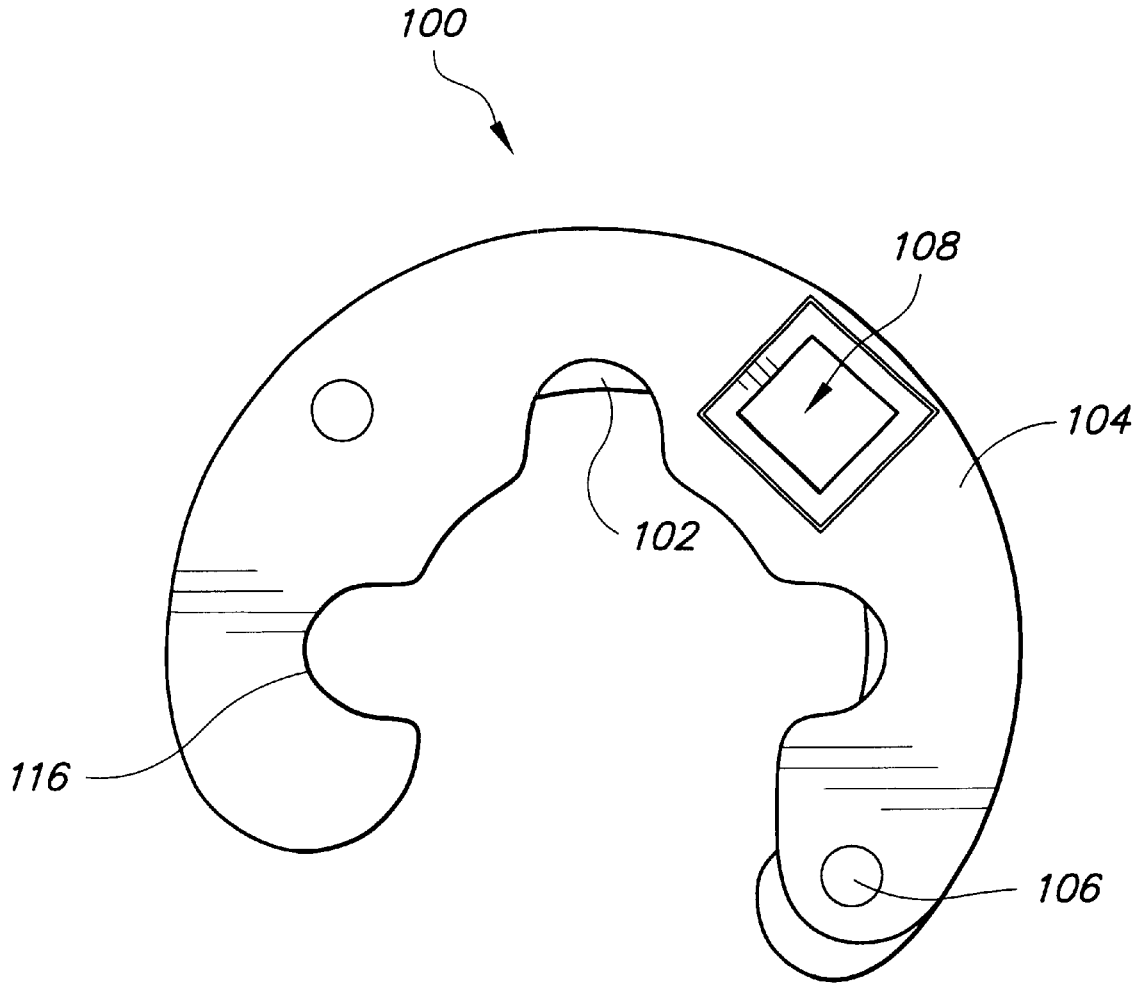
FIG. 8 is a bottom view of the assembled tool.

FIG. 7 is a top view of the assembled tool 100 and FIG. 8 is a bottom view of the assembled tool 100. Both figures show the novel configuration and innovative contour of the tool 100. The contour and configuration of the tool 100 is especially designed to allow the tool 100 to conveniently and efficiently perform the task of preventing the crankshaft pulley 114 from rotating as a torque is applied to the crankshaft sprocket bolt 112. The flat, arcuate shape of the top plate 102 and the baseplate 104 permit the tool 100 to be aligned parallel to the crankshaft pulley 114, the concave opening defined by the tool 100 being sized and dimensioned for permitting the recesses 116 to engage the heads of at least three crankshaft pulley bolts 120, so that the tool 100 may be thought of as the head of a wrench capable of engaging the heads of three bolts simultaneously to prevent rotation of the pulley. The top plate 102 and the baseplate 104 have sufficient thickness and strength to withstand the torque required to loosen or tighten the sprocket bolt 112.

Figure 9:
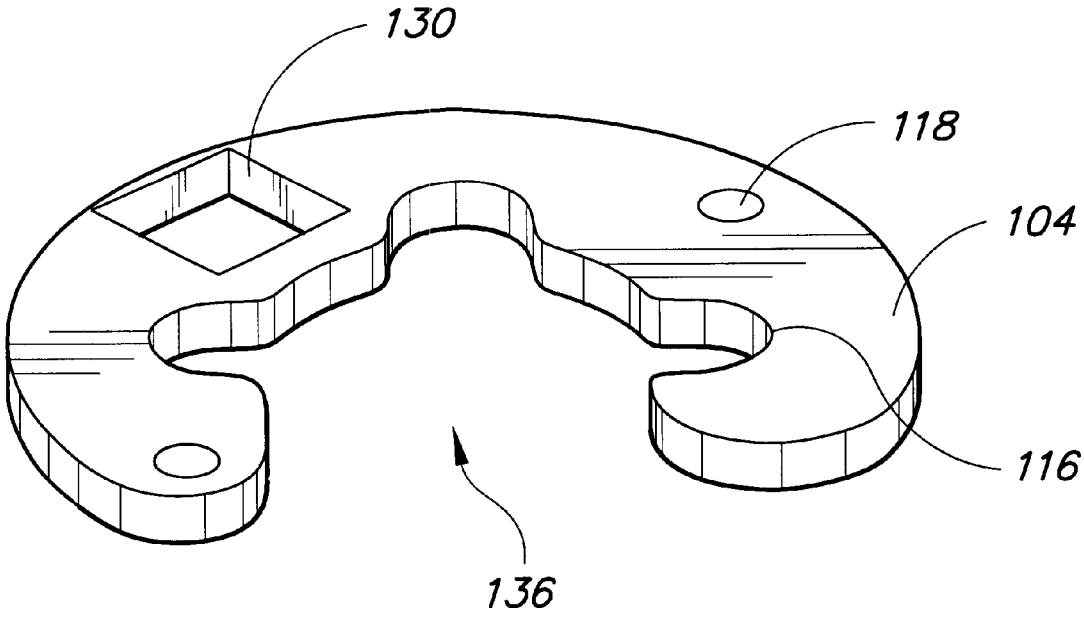
FIG. 9 is a perspective view of the base plate portion of the tool.

FIG. 9 is a perspective view of the baseplate portion 102 of the tool 100 showing the openings in the baseplate 102 into which the square drive boss 110 and the dowel pins 106 of the top portion 102 of the tool 100 are inserted. The openings in the baseplate 104 consists of a square hole 130 into which the square drive boss 110 fits and a pair of laterally disposed openings 118 into which the dowel pins 106 fit. In a preferred embodiment, the baseplate 104 has an outer diameter of 4 inches, an inner diameter of 1¾ inches, and a height of ¼ inches. The dowel pin holes have a depth of ¼ inches and the square hole 130 has a length of ¾ inches, a width of ¾ inches, and a height of ¼ inches. The recesses 116 have a length of ¾ inches, a height of ½ inches, and depth of ¼ inches. The recesses 116 are symmetrically disposed about the center 136 of the baseplate 104 so that the baseplate 104 can grip the pulley bolts 104 with a three-point or triangular grip.

Figure 10:
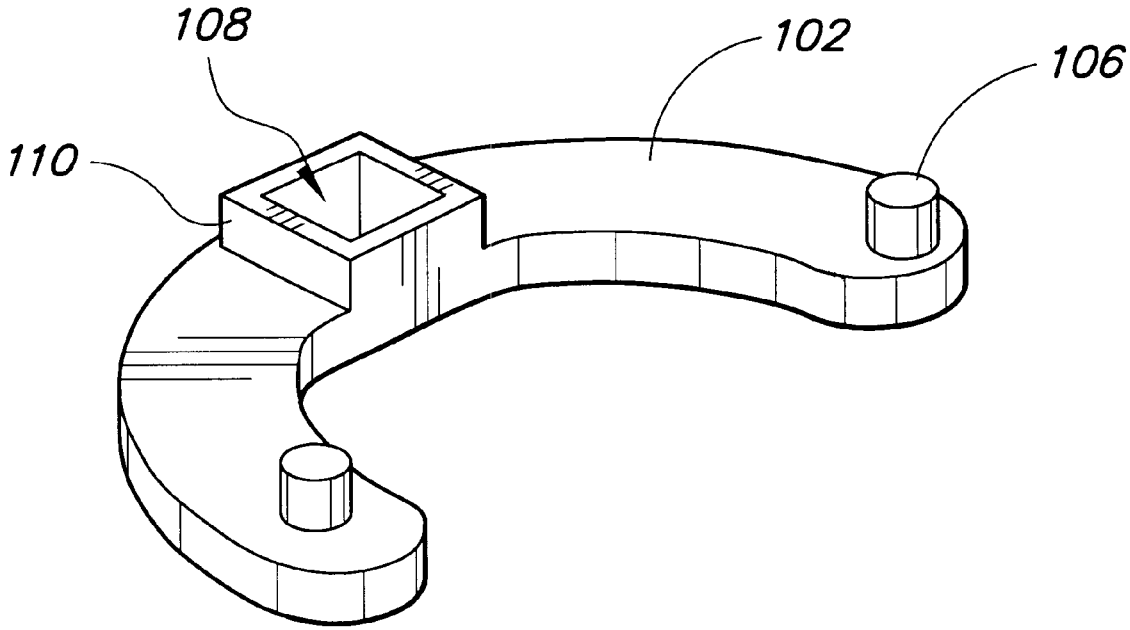
FIG. 10 is a perspective view of the top portion of the tool.

FIG. 10 is a perspective view of the top plate 102 of the tool 100 oriented to show the square drive boss 110 and the laterally disposed dowel pins 118. The square drive boss 110 has a raised appearance when viewed from the orientation of the tool 100 depicted in FIG. 10. The square drive boss 110 and the laterally disposed dowel pins 118 fit into their corresponding openings in the baseplate portion 104 of the tool 100. In a preferred embodiment, the top plate 102 of the tool 100 has an outer diameter of 4 inches and an inner diameter of 2½ inches. The dowel pins 106 have a diameter of ¼ inches and a length of ½ inches. The raised boss 110 has a length of ¾ inches, a width of ¾ inches, and a height of ¼ inches. The square drive hole 108 has a length ½ inches and width of ½ inches. The number of recesses 116 can be varied to meet the specific needs of the user.

Figure 11:
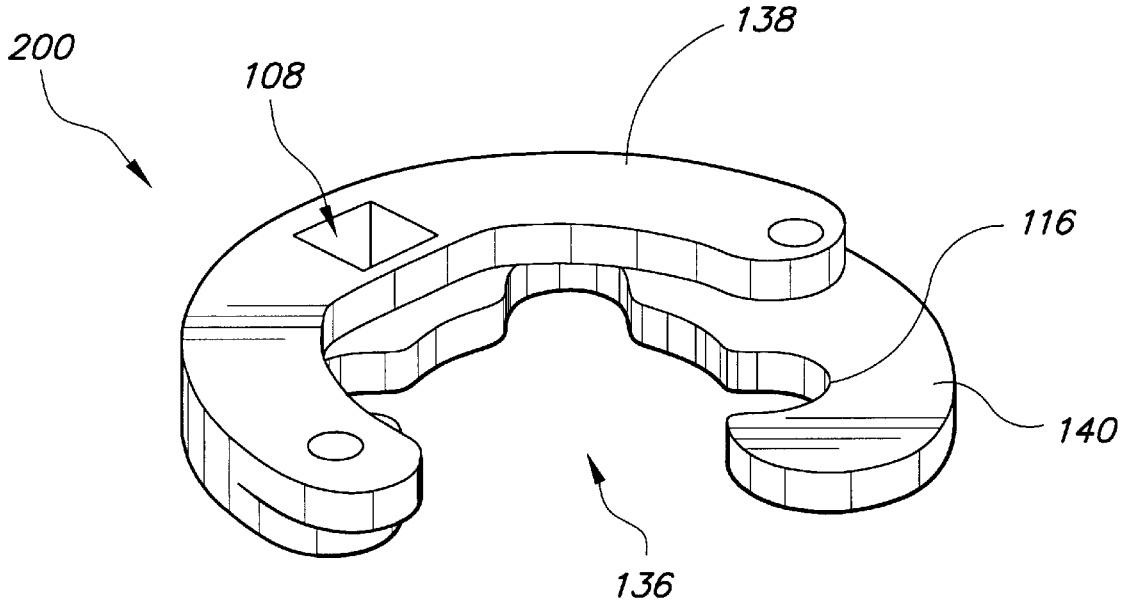
FIG. 11 is a perspective view of a second embodiment of the tool having a single, one piece construction.

FIG. 11 is a perspective view of a second embodiment of the tool 200. The tool 200 depicted in FIG. 11 has a single, one piece construction with a configured upper part 138 and a configured lower part 140. The tool 200 has a circular horseshoe shape and is open at one end as depicted in FIG. 11. The closed end of the tool 200 has a ½ inch square hole 108 defined therein for receiving a ½ inch square drive. There are three grooves 116 in the bottom of the tool 200 that are oriented toward the geometric center 136 of the tool 200. The grooves 116 are at right angles to each other. In a preferred embodiment, the tool 200 has a maximum thickness of ½ inches, an outer diameter of 4 inches, and an inner diameter of 1¾ inches. The two piece tool 100 has the same overall dimensions as the one piece tool 200. The tool 100,200 can be made of any suitable material, for example, a steel alloy.

In order to enhance the utility of the tool, the top plate 102 of the two-piece tool 100, or the entire one piece tool 200 may be magnetized. This causes the tool to adhere to the pulley by magnetic attraction so that the tool 100 or 200 doesn't slip or fall out of place while the mechanic is maneuvering for leverage to use the wrench 124 on the crankshaft bolt 112, or is setting the wrench 124 aside to complete removal of the bolt 112 by hand, or wishes to maintain the tool 100 or 200 on the pulley while his other hand is engaged in other tasks.

The crankshaft pulley holding tool or implement of the present invention makes it easy for the mechanic to remove or install the crankshaft sprocket bolt. By inserting a ½ inch drive ratchet, breaker bar, or extension into the ½ inch square drive hole of the tool and placing the recesses of the tool over the shaft pulley bolts heads, the mechanic can prevent the crankshaft from turning and easily loosen or tighten the crankshaft sprocket bolt. The two piece tool with its changeable baseplate is designed to accommodate crankshafts of different sizes while the one piece too is less expensive to manufacture. The tool can be used by mechanics in repair facilities, military auto craft shops, service stations, technical institutes, and by individuals with mechanical skills.

The preferred embodiment of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the embodiments described above, but encompasses any and all embodiments within the scope of the following claims.

I claim:

1. A tool for preventing rotation of a crankshaft pulley in order to facilitate the loosening and tightening of the crankshaft sprocket bolt comprising at least one flat, arcuate body having a concave inside edge, the inside edge having a plurality of recesses defined therein spaced apart and symmetrically disposed to engage a plurality of crankshaft pulley bolts, the body having a polygonal hole defined therein for receiving a drive of a breaker bar, whereby the tool may be placed about a crankshaft's pulley bolts and held stationary using a breaker bar while loosening and tightening a crankshaft sprocket bolt;

wherein at least a portion of said arcuate body is magnetized in order to maintain the tool against the crankshaft pulley.

2. The tool according to claim 1, wherein said at least one arcuate body consists of a one piece body.

3. The tool according to claim 1, wherein said at least one arcuate body comprises:

a) a flat, arcuate top plate having a top surface and a bottom surface and having a boss defining said polygonal hole, the boss projecting from the bottom surface of the top plate, the top plate having a plurality of dowel pins projecting from the bottom surface; and b) a flat, arcuate baseplate having a polygonal opening defined medially therein and a plurality of dowel openings defined therein, the baseplate defining a concave inside edge, said plurality of recesses being defined in the inside edge of the base plate, the top plate being removably attached to the baseplate with said boss disposed in said polygonal opening and said dowel pins disposed in said dowel openings.

4. The tool according to claim 1, wherein the polygonal hole is square in cross section for receiving a square drive breaker bar.

5. The tool according to claim 1, wherein said plurality of recesses consists of three symmetrically disposed recesses for gripping three crankshaft pulley bolt heads.

6. The tool according to claim 1, wherein the tool is made from a steel alloy.

7. A tool for preventing rotation of a crankshaft pulley in order to facilitate the loosening and tightening of the crankshaft sprocket bolt comprising:

a) a flat, arcuate top plate having a top surface and a bottom surface and having a boss defining a polygonal hole, the boss projecting from the bottom surface of the top plate, the top plate further having a plurality of dowel pins projecting from the bottom surface; and b) a flat, arcuate baseplate having a polygonal opening defined medially therein and a plurality of dowel openings defined therein, the baseplate defining a concave inside edge, the inside edge having a plurality of recesses defined therein spaced apart and symmetrically disposed to engage a plurality of crankshaft pulley bolts, the top plate being removably attached to the base plate with said boss disposed in said polygonal opening and said dowel pins disposed in said dowel openings, whereby the tool may be placed about a crankshaft's pulley bolts and held stationary using a breaker bar while loosening and tightening a crankshaft sprocket bolt.

8. The tool according to claim 7, wherein said baseplate defines a horseshoe shape.

9. The tool according to claim 7, wherein each said recess has a pair of opposed faces spaced apart a predetermined distance for engaging opposing faces of a crankshaft pulley bolt for preventing rotation of the bolt.

10. The tool according to claim 7, wherein the polygonal hole defined in said top plate is square in cross section for receiving a square drive breaker bar.

11. The tool according to claim 7, wherein said plurality of recesses consists of three symmetrically disposed recesses for gripping three crankshaft pulley bolt heads.

12. The tool according to claim 7, wherein the tool is made from a steel alloy.

13. The tool according to claim 7, wherein said top plate is magnetized.

14. A tool for preventing rotation of a crankshaft pulley in order to facilitate the loosening and tightening of the crankshaft sprocket bolt comprising at least one flat, arcuate body having a concave inside edge, the inside edge having a plurality of recesses defined therein spaced apart and symmetrically disposed to engage a plurality of crankshaft pulley bolts, the body having a polygonal hole defined therein for receiving a drive of a breaker bar, whereby the tool may be placed about a crankshaft's pulley bolts and held stationary using a breaker bar while loosening and tightening a crankshaft sprocket bolt;

wherein said at least one arcuate body comprises:

a) a flat, arcuate top plate having a top surface and a bottom surface and having a boss defining said polygonal hole, the boss projecting from the bottom surface of the top plate, the top plate having a plurality of dowel pins projecting from the bottom surface; and b) a flat, arcuate baseplate having a polygonal opening defined medially therein and a plurality of dowel openings defined therein, the baseplate defining a concave inside edge, said plurality of recesses being defined in the inside edge of the base plate, the top plate being removably attached to the baseplate with said boss disposed in said polygonal opening and said dowel pins disposed in said dowel openings.

* * * * *